US005826347A

United States Patent [19]

Olivares-Gonzalez de Serrano et al.

[11] Patent Number: 5,826,347

[45] Date of Patent: Oct. 27, 1998

[54] HYGIENIC FOOT DRIER

[76] Inventors: Nancy Olivares-Gonzalez de Serrano; Eugenio Serrano-Canseco, both of Jardines Del Prado #1832 Col. Jardines de las Torres, C.P. 64574 Monterrey, Nuevo Leon, Mexico

[21] Appl. No.: 898,837

[22] Filed: Jul. 23, 1997

[51] Int. Cl.[6] ..... F26B 19/00

[52] U.S. Cl. ..... 34/202; 34/233

[58] Field of Search ..... 34/202, 218, 233; 392/365, 379, 380; 132/73.5, 73.6

[56] References Cited

U.S. PATENT DOCUMENTS

| | | | |
|---|---|---|---|
| 3,378,009 | 4/1968 | Peplin | 34/202 |
| 5,157,850 | 10/1992 | Terng-Shuh | 34/202 |
| 5,280,679 | 1/1994 | Edelman | 34/202 X |
| 5,454,060 | 9/1995 | McDermott | 34/202 X |

*Primary Examiner*—Henry A. Bennett
*Assistant Examiner*—Steve Gravini
*Attorney, Agent, or Firm*—Laurence R. Brown

[57] ABSTRACT

This invention relates to a device which has been specifically conceived to dry feet thoroughly by means of hot air; it comprises an upper and a lower chamber. The lower chamber acts as a support for the upper chamber, and should be rectangular in shape and hermetically sealed. This lower chamber houses the ventilating mechanism which has an air intake for the fan which is driven by an electric motor fed by a cable; the fan generates the draft necessary for the drier to work. The drier is also fitted with a tubular resistor which heats up when electric current is applied and so warms the air in the lower chamber to a preferred temperature controlled by means of a regulator and a timer to pre-set the operating time The upper chamber is half enclosed with a convex cover and is positioned and supported on the walls of the lower chamber. Its function is to close in the air and direct it all around the top and sides of feet in a whirling fashion, so drying the upper part of the feet and the toe webs. Forty seconds are sufficient for a thorough drying. It is simple to operate, requiring only the use of an on-off switch, and stepping on and off the platform. The drier features and provides complete and hygienic feet drying, with the advantage of helping to eliminate the conditions in which fungi and viruses which attack feet develop.

6 Claims, 3 Drawing Sheets

HYGIENIC FOOT DRIER

BACKGROUND OF THE INVENTION

The prevention and cure of athlete's foot (mycosis) and verrucas on the soles of the feet (two of the ten most common skin complaints in this field), require constant, lengthy and costly treatment by a dermatologist.

Athlete's foot and verrucas are very easily transmitted, given the physical and biochemical characteristics of the microorganisms that cause them (fungi and viruses of this nature develop in the presence of moisture); they recur frequently and are difficult to treat with conventional means based on creams, topical solutions of imidazolic derivatives, oral medication, etc., which, although effective, are long and relatively costly.

Moisture on the feet plays a very important role in the transmission of the condition; easy and thorough drying of the feet is therefore fundamental to its treatment, to prevent the transmission of microorganisms and help in the eradication of the cause; proper drying helps both in the prevention and cure.

Since humidity offers the ideal condition for their multiplication, drying of the feet is one of the principal recommendations in the treatment of different cases of the above mentioned deseases, taking into account that the causative, agents are very unstable in a warm, dry environment.

The invention to which this application refers, is a spectacular development in the field of this subject, much research has been done into the morphology of the etiologic agents as well as the conditions to which they give rise, such investigation has been published in several recognized medical joumals. We have proved in numerous experiments to prove that drying the feet with hot air helps to prevent the disease and shortens the curative process.

As mentioned previously, treatment to cure the disease is long, as a consequence is often abandoned, leading to a high incidence of recurrence. Towels do not generally dry the foot completely and do not supply the heat necessary to help inactivate the microorganisms.

The present invention helps to resolve this problem by drying the feet thoroughly with hot air, suppressing the reproduction of both fungi and virus, the cause of verrucas.

We understand that hand and hair driers which operate with hot air conducted through tubes to dry off excess water, are well-known, but as far as we know, we are the first to invent a device applicable to foot hygiene and effective in attacking the problems mentioned. To date, no appliance exists specifically to dry feet.

The difference between our appliance and existing air driers is that the latter are designed to dry other areas and/or surfaces; hair driers consist of a device to generate hot air by means of a fan which draws air across a resistor which supplies the heat, conducting it through tubes to place close to the head; hand driers, generally wall-mounted, use a similar hot air generating device to hair driers, but with a dish or vane arrangement to direct the air onto the hands.

The present invention is a device which has been specifically conceived to dry feet thoroughly by means of hot air. Made from a material which does not conduct electricity, it comprises an upper and a lower chamber. The lower chamber acts as a support for the upper chamber, and should be rectangular in shape and hermetically sealed. This lower chamber houses the ventilating mechanism which has an air intake for the fan which is driven by an electric motor fed by a cable; the fan generates the draft necessary for the drier to work.

The drier is also fitted with a tubular resistor which heats up when electric current is applied and so warms the air in the lower chamber to a preferred temperature of fifty degrees centigrade, this temperature being controlled by means of a regulator fitted to one of the sides of the lower chamber and forming part of the drier's electrical circuit. The invention also features a timer to pre-set the operating time, so increasing safety by ensuring that the appliance fulfills its purpose and prevents excessive heat build up. The top of the lower chamber slopes upward at the half-way point in order to conduct the warm air in the direction of the upper chamber by means of a platform (which joins the two chambers) which is perforated to allow the air to pass into the upper chamber. This platform is grooved so that the user does not block the perforations with the soles of his/her feet on standing upon the device, as it is on the soles of the feet and toe webs that the microorganisms reproduce and cause the foot conditions mentioned. This appliance is designed to dry the whole foot, but especially the soles and toe webs. The drier is used by placing both feet on the platform mentioned (grooved and perforated) allowing the warm air to circulate around them. The upper chamber is half enclosed with a convex cover and is positioned and supported on the walls of the lower chamber. Its function is to close in the air and direct it all around the top and sides of feet in a whirling fashion, so drying the upper part of the feet and the toe webs. Forty seconds are sufficient for a thorough drying. It is simple to operate, requiring only the use of an on-off switch, and stepping on and off the platform.

DESCRIPTION OF THE INVENTION

Figure 1:
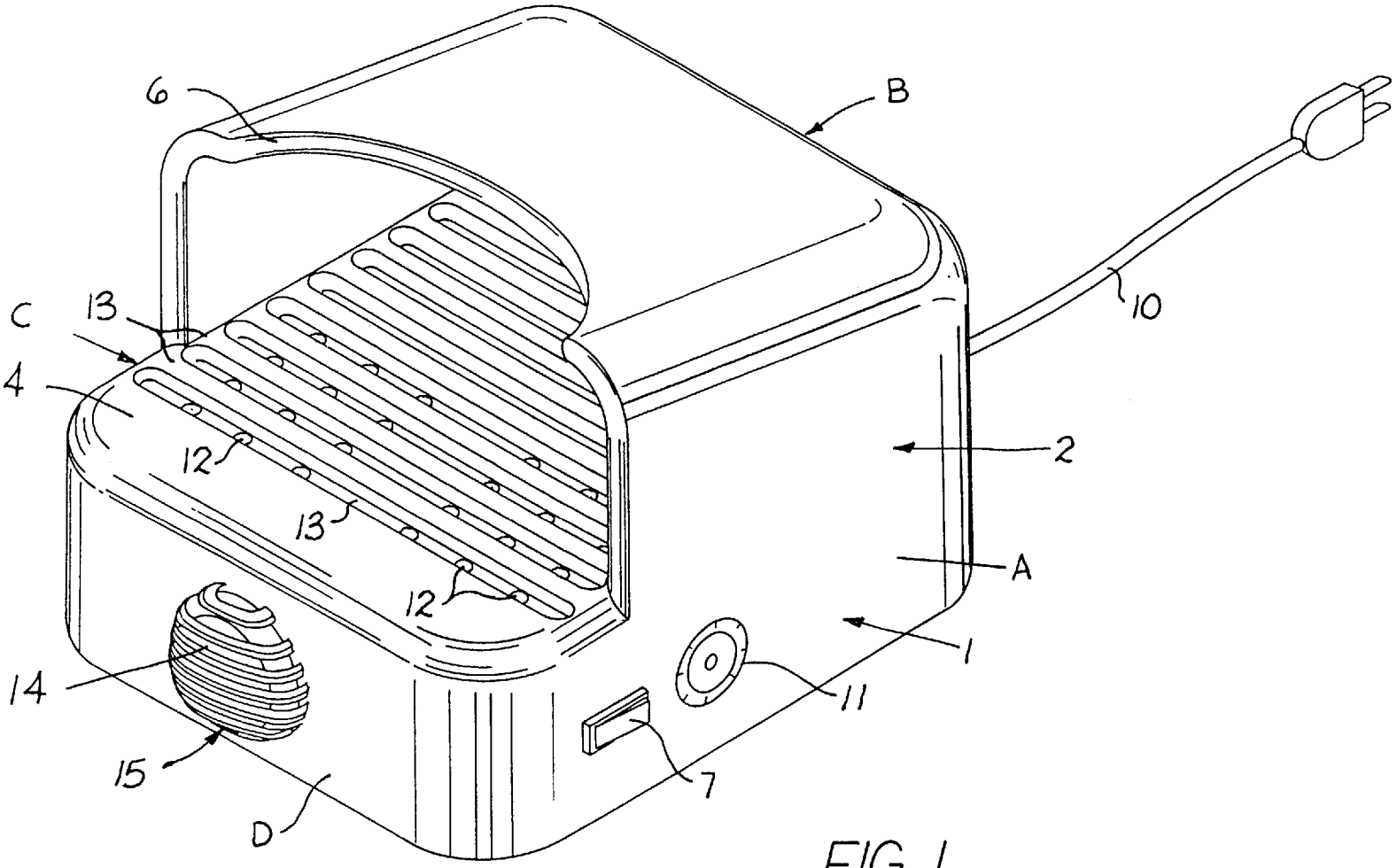
FIG. 1 shows an isometric view of the foot drier.
Figure 2:
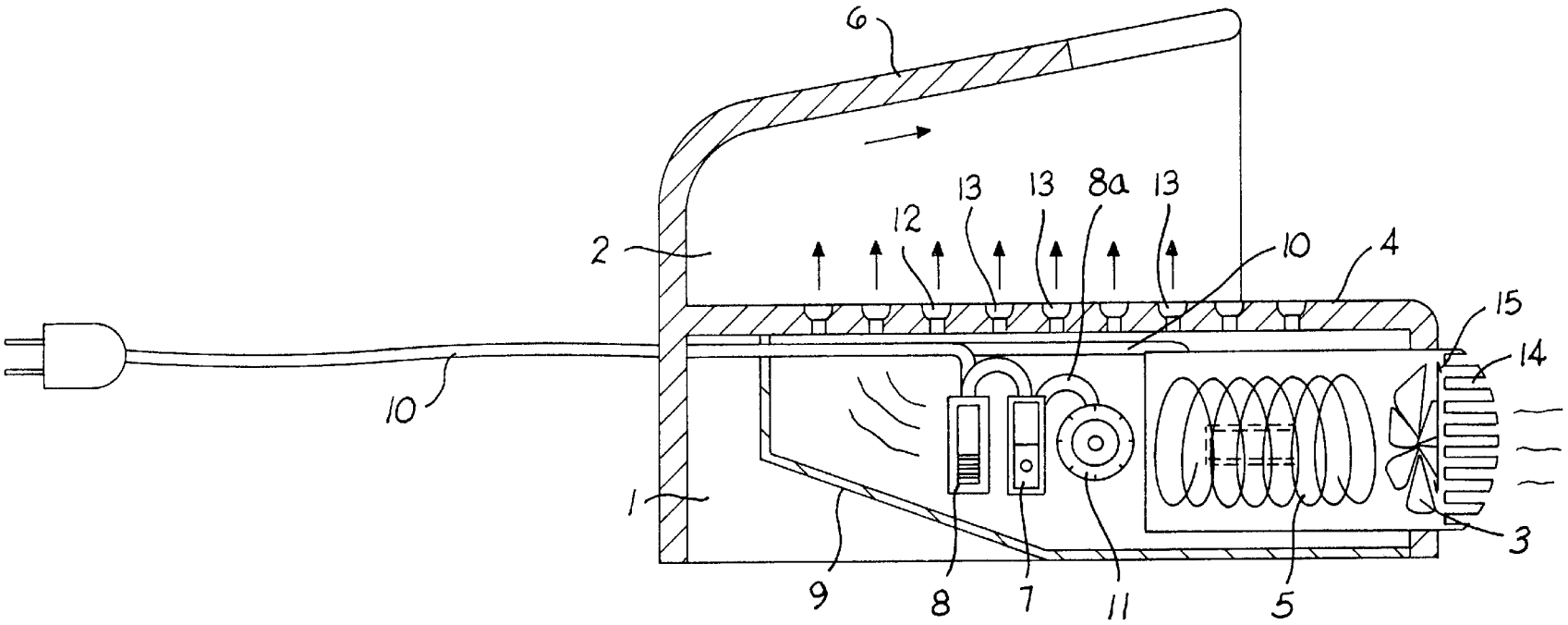
FIG. 2 shows a top view of a longitudinal section, showing the interior mechanism.
Figure 3:
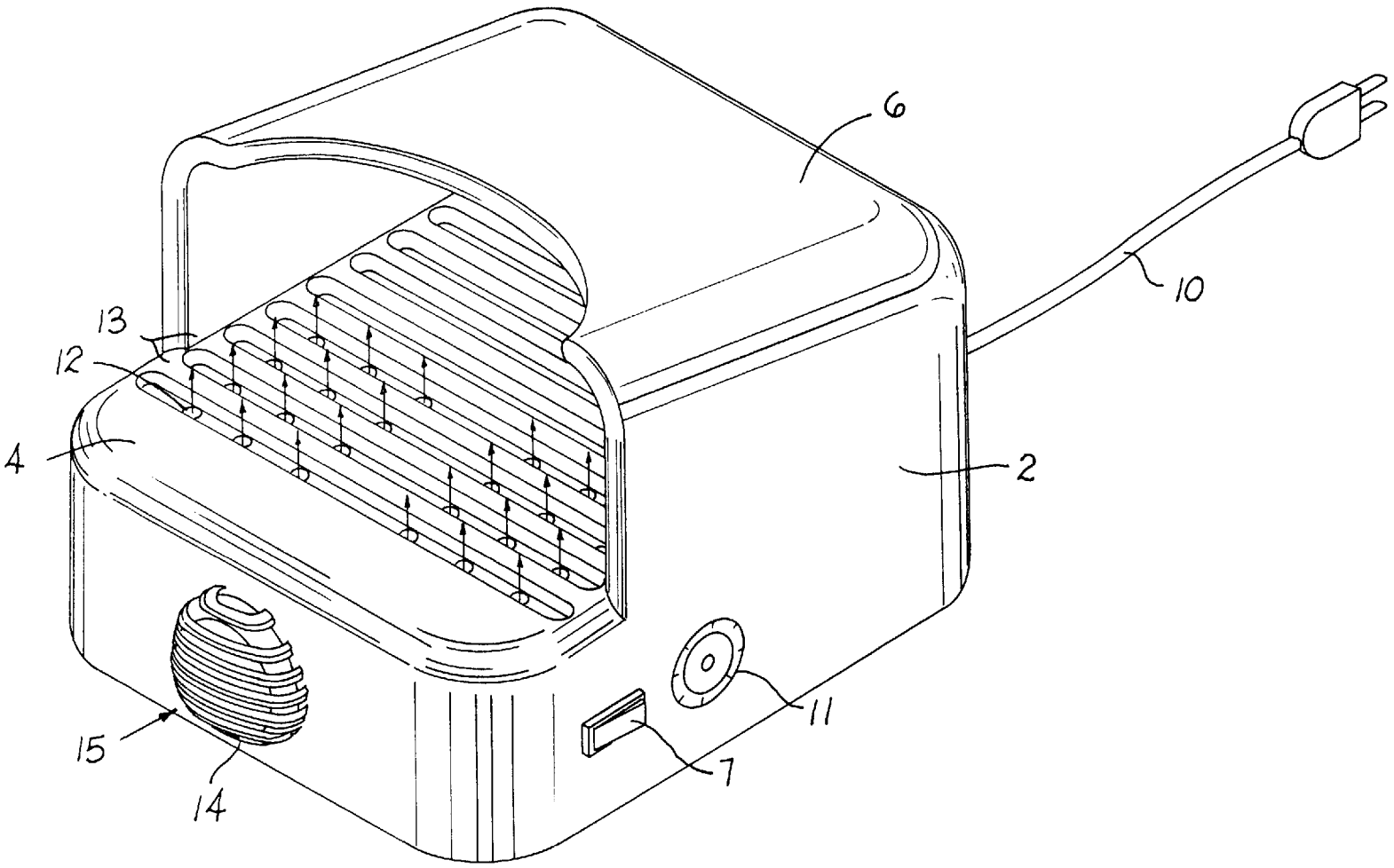
FIG. 3 shows a conventional view of the drier in operation.

In reference to said figures, the present invention comprises the combination two chambers, a lower (1) and an upper (2). In the inside **(1*a*) of the lower chamber (1) is housed the air generating mechanism which comprises a fan (3) and an electric cable (10) which is connected to the power source; an on/off switch (7); a manual temperature regulator (8) which enables the temperature to be set at 40, 50 or 60 degrees centigrade, as necessary; a cable connects the temperature regulator (8) to the resistor (5) by which means the resistor (5) may be activated and deactivated. When the resistor (5) is activated, the air is heated as it is drawn across the same driven by the fan (3)**.

The lower chamber (1) is formed by four walls (a, b, c, d) and houses a deflector (9) which slopes upward to direct the draft toward the platform (4); said deflector (9) is hermetically fixed to the four walls (a, b, c, d) of the lower chamber (1).

The platform (4) which forms the top of the lower chamber (1) combines a series of grooves (13) which prevent the feet from blocking the perforations (12) through which the warm air passes into the upper chamber (2), since said perforations (12) are located at the bottom of the grooves.

The upper chamber (2) has a half-domed cover (6) which encloses the warm air which by the strength of the draft is displaced in different directions within the upper chamber (2) in a revolving fashion. Said upper chamber (2) is supported by the four walls (a, b, c, d) of the lower chamber (1).

The number of grooves (13) and perforations (12) may vary according to the dimensions and specifications of the drier.

The drier is powered by means of electric current which is activated by pressing the on/off switch (7) which may in turn be connected to a timer (11) with which it is possible to pre-set the drier's working cycle. When the drier is operating, the user places his/her wet feet on the platform (4) so that they are covered by the half dome (6) for approximately 40 seconds or until the feet are completely dry. The process can be interrupted at any time by simply stepping off the platform or switching off the appliance the operating temperature may be adjusted as required by means of the manual temperature regulator (8).

An air intake (14) should be fitted in any of the four walls (a, b, c, d) of the lower chamber (1) but behind the fan (3), through this air intake (14). air will be drawn from the outside by the fan (3); the air intake (14) will have a check valve (15) to prevent air from exiting through the same and so ensure that the air travels through the perforations (12) and grooves (13) in the platform (4).

What is claimed is:

1. A hygienic foot drier comprising in combination:

housing means for encompassing a foot including a hooded foot rest compartment having perforated platform means for receiving foot soles while permitting air to contact the soles of a foot placed upon the platform, air circulation means for passing air into the hooded compartment through said perforated platform and into the hooded compartment in a pattern for contacting the top, bottom and side skin of a foot, and air heating means for circulating warm, dry air through said compartment to contact said bottom, top and side skin of a foot.

2. The hygienic foot drier of claim 1 further comprising: temperature regulation means for said air heating means to maintain an air circulation temperature of the order of 50 degrees Centigrade.

3. The hygienic foot drier of claim 1 further comprising: air deflection means in the hooded compartment for forming a whirling air pattern for contacting the skin of a foot.

4. The hygienic foot drier of claim 1 wherein said perforated platform means further comprises a grooved panel for receiving the sole of a foot overlies and is spaced from a perforated panel for entry of air from said air circulation means to the sole.

5. The hygienic foot drier of claim 1 further comprising: an electrically operated system including timing means for establishing a treatment cycle of predetermined time for heating and circulating air.

6. The hygienic foot drier of claim 1 further comprising: air intake means for introducing uncirculated fresh air into the air cirulation means.

* * * * *